US009180501B1

(12) United States Patent
Keller et al.

(10) Patent No.: US 9,180,501 B1
(45) Date of Patent: Nov. 10, 2015

(54) ROLL ARRANGEMENT

(71) Applicant: SMS Siemag AG, Duesseldorf (DE)

(72) Inventors: Karl Keller, Hilchenbach (DE); Johannes Alken, Siegen (DE); Konrad Roeingh, Hilchenbach (DE)

(73) Assignee: SMS GROUP GMBH, Duesseldorf (DE)

( * ) Notice: Subject to any disclaimer, the term of this patent is extended or adjusted under 35 U.S.C. 154(b) by 0 days.

(21) Appl. No.: 14/406,763

(22) PCT Filed: Jun. 7, 2013

(86) PCT No.: PCT/EP2013/061822
§ 371 (c)(1),
(2) Date: Mar. 26, 2015

(87) PCT Pub. No.: WO2013/186142
PCT Pub. Date: Dec. 19, 2013

(30) Foreign Application Priority Data

Jun. 12, 2012 (DE) ..... 10 2012 209 831

(51) Int. Cl.
*B21B 13/00* (2006.01)
*B21B 31/07* (2006.01)

(52) U.S. Cl.
CPC ..... *B21B 13/00* (2013.01); *B21B 31/07* (2013.01)

(58) Field of Classification Search
CPC ..... B21B 13/00; B21B 13/06; B21B 31/07; B21B 31/074; B21B 31/078
See application file for complete search history.

(56) References Cited

U.S. PATENT DOCUMENTS

| | | | | |
|---|---|---|---|---|
| 2,955,002 | A | 10/1960 | Rich, Jr. | |
| 4,159,152 | A | 6/1979 | Bjork | |
| 4,944,609 | A | 7/1990 | Salter, Jr. | |
| 6,468,194 | B2 | 10/2002 | Wojtkowski | |
| 6,604,859 | B1 | 8/2003 | Bonazoli | |
| 7,484,891 | B2 | 2/2009 | Keller | |
| 2010/0284639 | A1 * | 11/2010 | Keller | B21B 31/07 384/428 |

FOREIGN PATENT DOCUMENTS

FR 2405761 5/1979

OTHER PUBLICATIONS

Morgoil-KLX®—Lager (Bearing) SMS Group Newsletter, No. 1, 2009.

* cited by examiner

*Primary Examiner* — Teresa M Ekiert
(74) *Attorney, Agent, or Firm* — Abelman, Frayne & Schwab

(57) ABSTRACT

The invention relates to a roll arrangement for use in metallurgical technology, comprising a roll that has a roll barrel (11) and two roll necks (10), and at least one neck bushing (20) for accommodating at least one of the roll necks without a clearance in a rotationally fixed manner. In order to increase the load-bearing capacity of the roll bearing without increasing the size of or the mounting space for the roll arrangement, a circumferential cavity is formed between the neck bushing (20) and the roll neck (10) in the unloaded state of the roll arrangement.

8 Claims, 4 Drawing Sheets

11
20
13,21
10
15
d
R(x)
x
ΔR(x)
ΔR(x)=a0*x0+a1*x1+a2*x2+....+an*xn
ΔR(x)=a0*x0+a1*x1+a2*x2
ΔR(x)=a0*x0+a1*x1;(a1>0)
ΔR(x)=a0*x0=const.
ΔR(x)=a0*x0+a1*x1;(a1<0)

ROLL ARRANGEMENT

RELATED APPLICATIONS

This application is a National Stage application of International application PCT/EP2013/061822 filed Jun. 7, 2013 and claiming priority of German application DE 10 2012 20983 filed Jun. 12, 2012, both application being incorporated herein by reference thereto The invention relates to a roll arrangement for use in metallurgy and including a roll having a roll body and two roll necks, and a least one neck bushing for receiving at least one roll neck without a possibility of rotation relative thereto and without a radial clearance therebetween.

The state-of-the art discloses roll arrangements in which roll necks are received in cylindrical or conical neck bushings. E.g., in rolling mills, an oil film support is used for supporting a back-up roll that absorbs the rolling force applied by an adjusting cylinder and transmits it to a work roll. Here, also high-loaded slide bearings are used which operate primarily in the Sommerfeld region, i.e., with a relatively low rotational speed and under a high load. At very high pressures, partially above 1,500 bar that is created in the load zone, an elastic deformation or flattening of pressure-loaded surfaces take place. The flattening produces large pressure-active surfaces facing in the acting direction of the outer force applied, e.g., by the adjusting cylinder. Thus, the bearing can withstand a greater force. This effect is called "Electrohydrodynamic (HID) increase of a load-bearing capacity. To further increase this effect, a so-called Morgoil-KLX® bearing is used which includes a thin-walled, conical neck bushing used as a running surface, see U.S. Pat. No. 6,468,194 and European Publication EP 1 213 061.

The publication "Newsletter January/2009, SMS Group, 16, No. 1 Apr. 1, 2009, p.p. 50-51 "discloses use of Morgoil-KLX® bearing for roll arrangements and which has a neck bushing for receiving a conical roll neck. For torque transmission, a key is provided between the neck bushing and the roll neck.

European Patent EP 1 651 876 B1 discloses an oil film support for a roll neck supported in a neck bushing which in turn is surrounded by a bearing bushing arranged in a chock.

German Publication DE 603 03 052 T2 discloses an oil film support for use in a rolling mill and a bushing for rotationally supporting a neck surface of a roll neck, wherein the cylindrical bushing has depressions for receiving an oil film.

German Publication DE 38 76 663 T2 discloses a bushing for supporting a bearing on a hydrodynamic lubrication film.

The drawback of the known solutions consists in that for transmission of very high loads, large dimensions of the support adapted to a load are needed.

The object of the invention is to further increase the load-bearing capacity of the roll arrangement, without increasing the dimensions and the chock size of the roll arrangement.

This object is achieved, according to the invention, with features of claim 1. The invention describes a roll arrangement for use in metallurgy and including a roll having a roll barrel and two roll necks, at least one neck bushing for receiving at least one roll neck for joint rotation therewith and without a radial clearance therebetween. The invention is particularly characterized in that in a non-loaded condition, a circumferential hollow space is formed between the neck bushing and the roll neck.

The hollow space is precisely pre-dimensioned dependent on a maximal bearing force. The circumferential hollow space is in form of a rotationally symmetrical annular gap that forms a circumferential hollow profile in a plane extending transverse to the longitudinal axis of the roll arrangement.

The inventive hollow space provides an increased free space between the neck bushing and the roll neck in which the neck bushing can be locally flattened under load in the spatial region of the force application. The flattening of the neck bushing increases the pressure-active surface that is subjected to forces, and the load-carrying capacity of the roll arrangement noticeably increases, without need to increase its size. For details, see the section "Functionality" at the end of the description.

According to the first embodiment, it is contemplated that the hollow space is increased and limited by a rotationally symmetrical concave shape provided on an outer surface of the roll neck and/or on an inner surface of the neck bushing.

According to a further embodiment of the invention, it is contemplated that the outer surface of the roll neck and/or the inner surface of the neck bushing continues, in the region of its concave shape, when viewed in the longitudinal direction of the roll arrangement, at least sectionally in form of a straight-line, a sinus curve, a polygonal curve R(x)n-tenth degree, or as their combination. In order to insure a stable support of the neck bushing on the roll neck without a radial clearance, the neck bushing and the roll neck have, in the axial direction adjacent to the hollow space, adjoining bearing surfaces.

It is further provided that a profile of the outer surface of the roll neck or the inner surface of the neck bushing in a region of its concave shape, when viewed in the longitudinal direction of the roll arrangement, in the transition region between two adjacent sections, is continuously differential. Advantageously, there are provided, between separate profile section of the profile, smooth transitions without edges in order to prevent, in case of a load, formation of impress point, e.g., scoring points on opposite surfaces of the neck bushing and the roll neck. Thereby, advantageously, this also prevents, at least to some extent, drawbacks of a possible notch effect.

It is further contemplated that the contour of the outer surface of the roll neck or the contour of the inner surface of the neck bushing correlates, in the region of its concave profile, viewed in the longitudinal direction of the roll arrangement, i.e., in the axial direction, with the distribution of the bearing force in the axial direction so that as large as possible flattening of neck bushing is locally achieved in its elastic region under load, which leads to a maximal load-bearing capacity of the roll arrangement at an unchanged size.

The invention contemplates that the outer surface of the roll neck and the inner surface of the neck bushing are formed as truncated cones complementary to each other. Advantageously, the cone profile provides for easy mounting of the neck bushing on the roll neck and its dismounting therefrom.

According to alternative embodiment of the invention, the outer surface of the roll neck and the inner surface of the neck bushing are formed complementary cylindrical. Advantageously, in this case the neck bushing is shrunk on the roll neck to provide a forcelocking connection without a radial clearance.

According to the invention, the roll is formed as a back-up roll, intermediate roll, or work roll for use in a rolling mill stand.

According to a still further embodiment of the invention, it is provided that the arrangement further includes at least one chock with a bearing bushing in which the neck bushing, together with the roll neck and/or with the roll, is received, with a load-carrying oil film being provided between the neck bushing and the bearing bushing.

Generally, the inventive arrangement provides a simple and cost-effective possibility to replace or to use the inventive roll arrangement for an available roll arrangement, e.g., in a rolling installation to provide for increase of the load-carrying capacity and performance, without the need to change the available installation space. The inventive arrangement can be easily mounted. In case of repair, it can be easily and quickly replaced.

Further features and advantages of the invention follow from dependent claims and the following description that describes in detail embodiments of the invention which are shown in the drawings. Here, in addition to the above-described combinations of features, the features themselves or in other combinations are essential to the invention.

DESCRIPTION OF THE DRAWINGS

The invention will be described in detail below with reference to FIGS. 1 through 4. It is shown in:

FIG. 1 shows a roll arrangement 100 for use, e.g., in metallurgy and including a roll having a roll barrel 11 and at least one cylindrical neck 10. The roll neck 10 is supported in a cylindrical receiving bore of a complementary neck bushing 20, without a radial clearance and for joint rotation therewith. In order to provide a forcelocking connection without a radial clearance, the neck bushing 20 is, e.g., shrunk on the roll neck 10. Advantageously, between the roll neck 10 and the neck bushing 20, there is provided at least one carrier member 23, e.g., in form of a key or in form of a specially formed sliding block.

Figure 1:
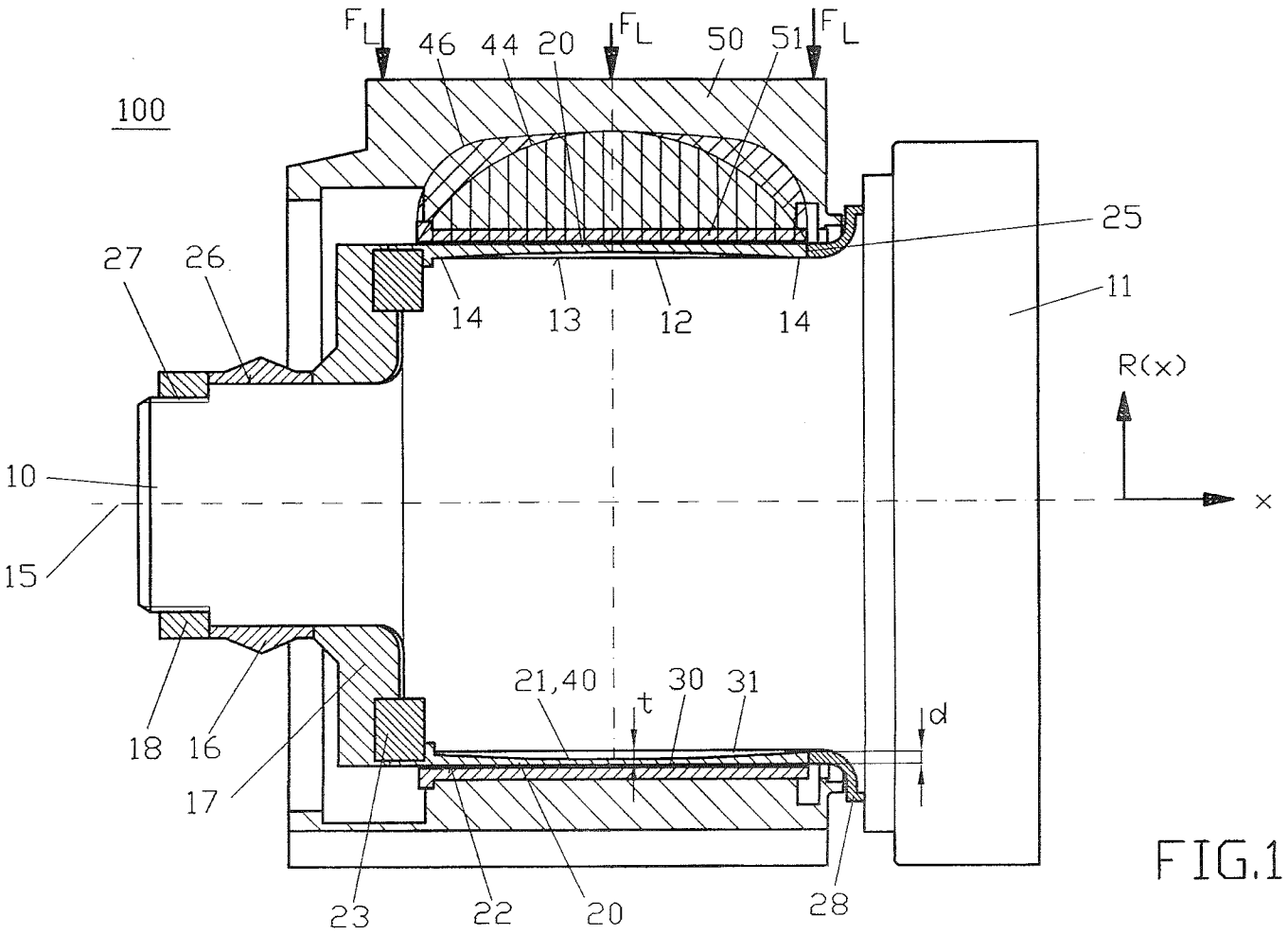
FIG. 1 a roll with a profiled cylindrical neck bushing.

The inner surface 21 of the neck bushing 20 and/or the outer surface 20 of the roll neck are provided with a concave contour, further profile 40 that is produced, e.g., by drilling and/or grinding. The profile 40 continues, in the region of its concave shape, viewed in the longitudinal direction of the neck bushing 20, in form of a straight line, sinus curve, polygonal curve (R(x)n-tenth degree, or as their combination. The profile 40 can, however, can be formed as a simple parabola-shaped curve.

The curve sections or curve elements form on the neck bushing 20 or on roll neck 10 depressions which form a radially circumferential rotationally symmetrical hollow space 12 between the neck bushing 20 and the roll neck 10 in unloaded condition when the neck bushing is mounted on the roll neck. The hollow space 12 is in form of an annular gap, i.e., in form of a rotationally symmetrical hollow profile. The outer surface 22 of the neck bushing 20 and the outer surface 13 of the roll neck 10 are, e.g., cylindrical in the embodiment shown in FIG. 1.

It is possible to provide the above-described profile 40 on the outer surface 13 of the roll neck 10, and form the inner surface 21 of the neck bushing 20 cylindrical. The above-described profile 40 can be formed on both the inner surface of neck bushing and the outer surface of the roll neck, preferably, opposite each other.

For limiting the push-in position of the neck bushing 20 when it is pushed on the roll neck 10, a spacer ring 28 with a stop 25 is arranged between the end side of the roll barrel 11 and the neck bushing 20. Alternatively, the roll barrel can be provided, on its end side, with a heel, as a stop 25 (not shown), that is formed as one-piece with the roll barrel. The neck bushing 20 is tightened and secured in the axial direction (x) against the spacer 28 from axial displacement, after being pushed on the roll neck 10, with a pressure shoulder ring 17 via an axial bearing-inner ring 16 optionally provided for supporting the roll neck 10, and a nut 18. Here, the roll neck 10 is provided at its end with a hub portion 26 for mounting the shoulder ring 17 and an adjacent thereto, threaded neck portion 27 for receiving the nut 18.

Figure 2:
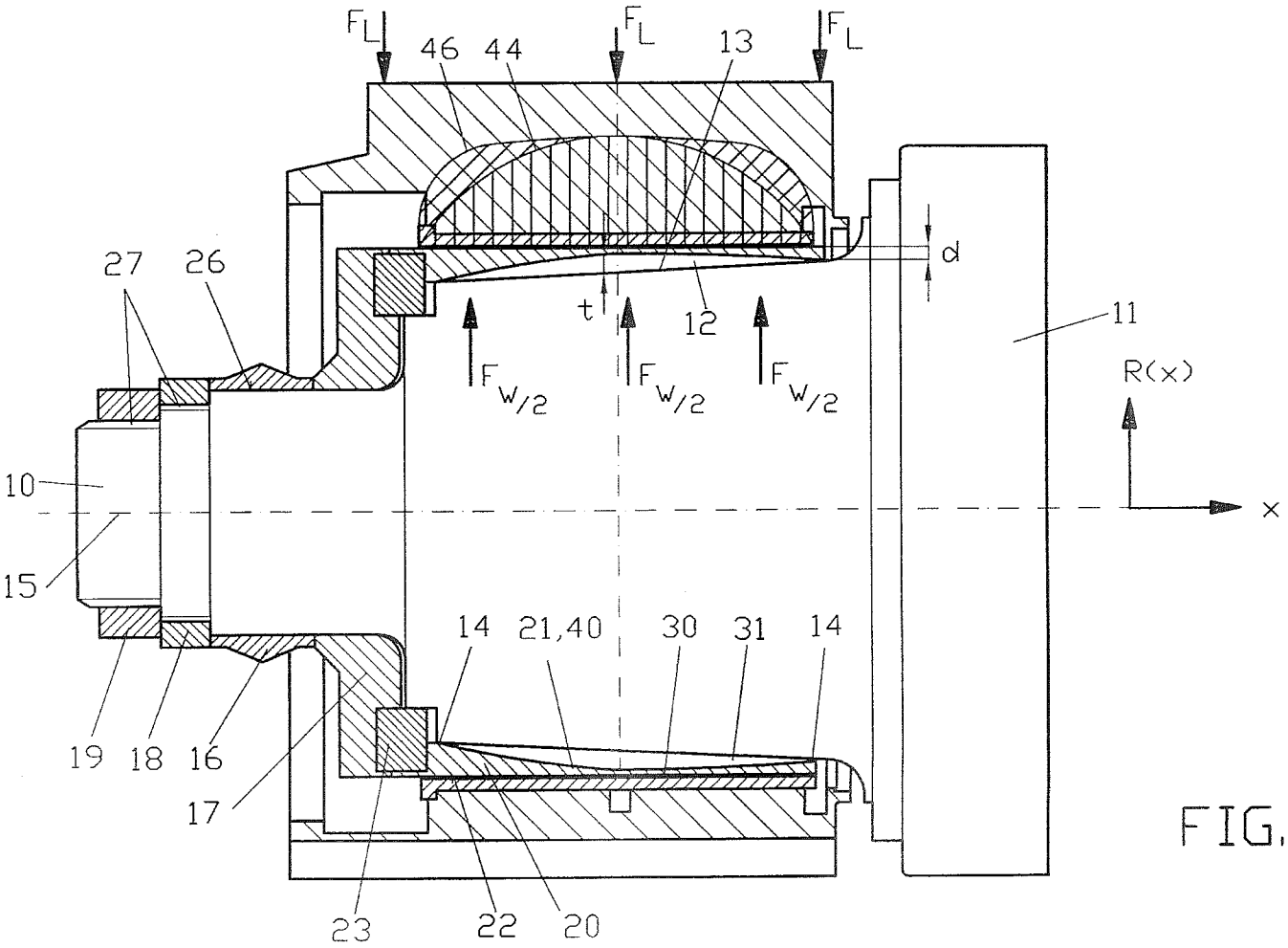
FIG. 2 a roll with a profiled conical neck bushing.

FIGS. 1 and 2 schematically show an axial bearing-inner ring 16 between the pressure-shoulder ring 17 and the nut 18. The nut 18 can be additionally secured against loosening with rotation-preventing element 19, e.g., a counter-nut.

The depth t of the profile 40 or the size of the resulting additional hollow space 12 between the neck bushing 20 and the roll neck 10 is so adapted, dependent on a maximum generated bearing force F and the elasticity module of the neck bushing, that the volume of the hollow space 12 becomes greater the greater is the maximal bearing force in the loaded condition, whereby the deformation of the neck bushing 20 always remains in the elastic region. The actual depths t of the profiles range is the micrometer (μm)-region, preferably, up to 1,000 μm.

The wall thickness d of the cylindrical neck bushing amounts to between 10 mm and 75 mm, without taking into account the described below, optional rotationally symmetrical concave structure.

In addition, at least one chock 50 with a bearing bushing 51 can be provided for receiving the neck bushing 20 together with the roll neck 10, wherein a load-carrying oil film 30 is provided between the outer surface 22 of the neck bushing 20 and bearing bushing 51 of the chock 50. The arrangement is called also as load-carrying oil film support. According to a preferred embodiment, the inner surface of the bearing bushing 51 is coated with anti-friction metal lining, e.g., with babbit metal.

In the embodiment according to FIG. 2, the roll neck 10 is in form of a truncated cone. The inner surface 21 of the neck bushing 20 is formed complementary to the ideal (without profiling) truncated cone shape of the roll neck 10. Here, as described above, a profile 40 is provided on the inner surface of the neck bushing 20 and/or the outer surface of the roll neck 10.

In this embodiment, the neck bushing 20 is pushed onto the roll neck 10 until a radial clearance between the neck bushing 20 and the roll neck 10 is eliminated. Finally, the neck bushing 20 is tightened and is secured against displacement, as described above with the reference to FIG. 1.

In order to insure a stable positioning of the neck bearing 20 on the roll neck 10 without a radial clearance therebetween, the neck bushing 20 and the roll neck 10 have, viewing in the axial direction, on both sides, facing toward the hollow space, adjoining each other, bearing surfaces 14.

The wall thickness of the conical neck bushing 20 amounts, at its thinner end to between 10 mm and 75 mm.

In addition, to prevent a micro-cold welding due to microfriction, a lubrication film 30 is provided between the neck bushing 20 and the roll neck 10. The profile 40 is provided, as it was described with reference to FIG. 1, on the neck bushing 20 or on the roll neck 10 also at their conical shape.

Figures 3A, 3B, 3C:
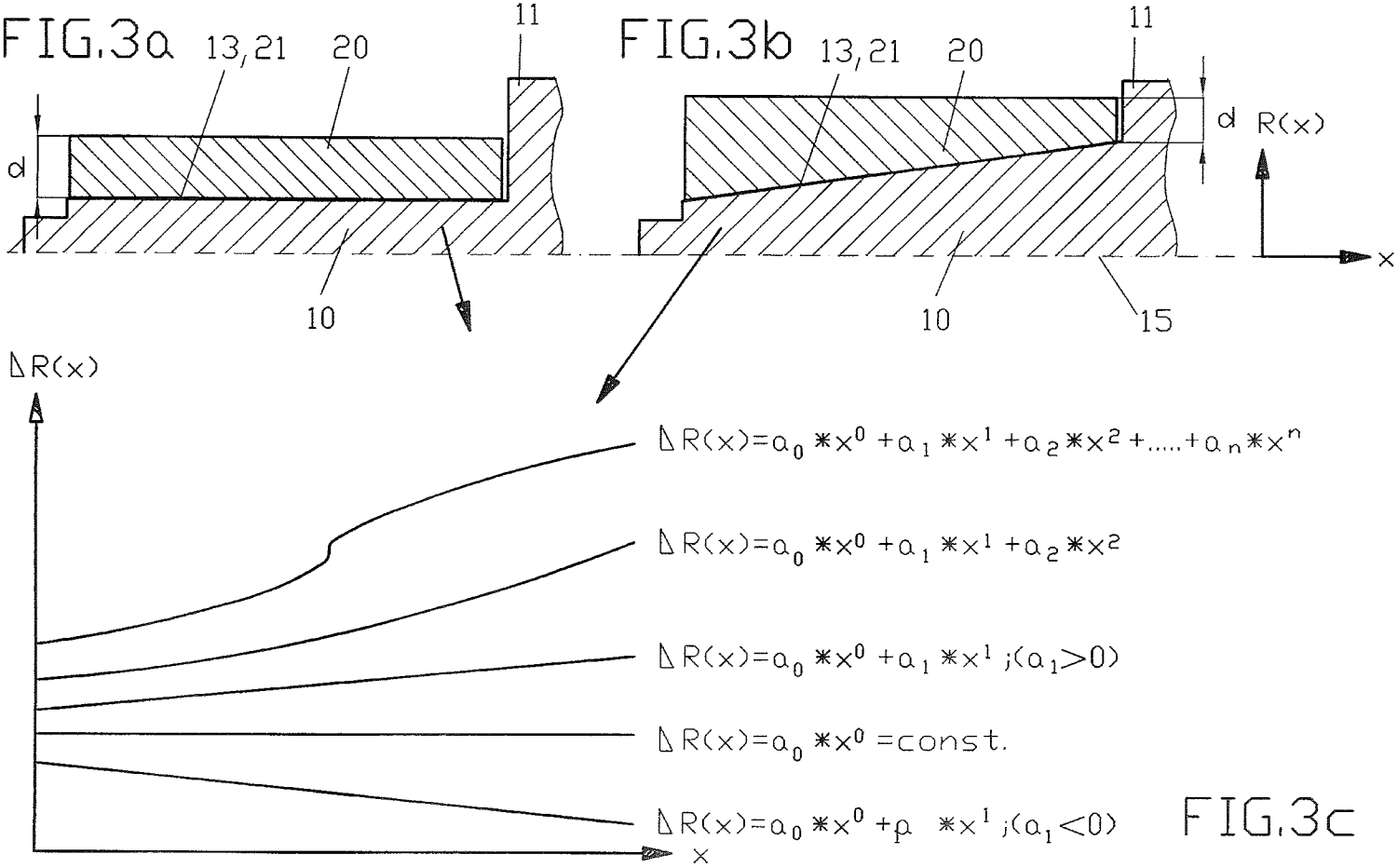
FIGS. 3*a*-3*c* different profile patterns of the outer surface of the roll neck and/or the inner surface of the neck bushing.

FIGS. 3*a* and 3*b* show, in principle, the roll arrangement 100 having a roll and at least one neck bushing 20 for receiving one of the roll neck clearance-free and for joint rotation therewith. Here, the outer surface 13 of the roll neck 10 and the inner surface 21 of the neck bushing 20 can be formed either cylindrical or as truncated cone, with two surfaces 13 and 21 being formed complementary to each other and adjoining each other without a radial clearance therebetween.

The profile 40 of the inner surface 21 of the neck bushing 20 and/or of the outer surface 13 of the roll neck 10, can be formed, according to the embodiment shown in FIG. 3*c*, e.g., as different profiles expressed mathematically as function R(x)n-tenth degree dependent on the load or in combination with other profiles. In order to insure an edge-free transition between combined with each other profile sections, the profile 40 is formed between two adjacent profile sections so that it is constantly differential profile sections. It is to be noted that the curve lines shown in FIG. 3*b* do not actually illustrate the profiles used in practice. The illustrated number of curve or profile sections simply show schematically different possible profile variations.

Functionality

Figure 4:
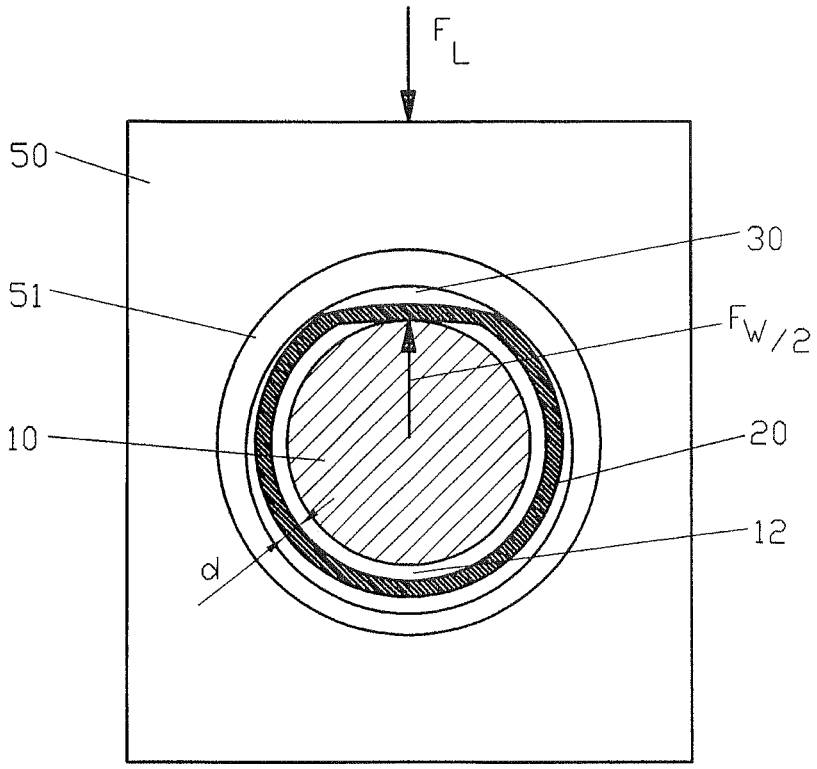
FIG. 4 illustration of elastic deformation of the neck bushing in the region of the maximal hollow space in cross-section.

The functionality of the invention will be described below with reference to FIG. 4.

The inventive rotationally symmetrical hollow space 12 between the neck bushing 20 and roll neck 10, which is formed as a result of formation of the profile 40, provides between the neck bushing 20 and the roll neck 10, an increased free space in which the neck bushing 20 can expand at the location of the force effect.

In this way, during a rolling operation in a rolling mill stand, at least essentially vertically upward directed rolling force $F_W$ acts on the upper (back-up) roll, whereas simultaneously at least essentially vertically downward directed rolling force Fw acts on the lower (back-up) roll. These rolling forces are transmitted from the roll barrels, respectively, by half on the roll necks, whereby the roll necks are pressed upwardly in the upper chock and downwardly in the lower chock.

The rolling forces are transmitted according to a functional chain, from the roll neck through the neck bushing, the load-carrying oil film between the neck bushing and the bearing bushing, the bearing bushing to the chock. The chock transmits the rolling forces further to the rolling mill stand in which the chock is supported.

Ideally, the chock and the bearing bushing supported in the chock, should be seen as unyielding to and incompressible by the rolling forces. I.e., the chock and the bearing bushing completely absorb acting thereon respective halves of the rolling forces $F_W/_2$ (action), while they, respectively, repulse the equal but oppositely directed bearing forces $F_L$ (reaction).

Already when a small rolling force $F_W$ acts on a roll neck 10 during the rolling operation, the roll neck 10, together with the neck bushing 20, apply pressure in the direction of the rolling force $F_W$ to the chock via the load-carrying oil film 30, the bearing bushing 51, and the chock, see FIG. 2. But here, the neck bushing 20 impacts the incompressible load-carrying oil film 30 that itself acts on the unyielding bearing bushing 51 and the unyielding chock 50, which prevents yielding in the direction of the rolling force. Consequentially, the neck busing is prevented from yielding by the opposite bearing force $F_L$ in the direction of the rolling force.

The neck bushing 20 itself, together with the inventive hollow space 12 toward the roll neck 10, is the weakest link in the above-discussed functional chain of the (rolling) force.

While the neck bushing 20 cannot avoid the rolling force, the load applied during the rolling operation, causes an elastic deformation of the neck bushing 20. Under the action of the rolling force $F_W/_2$ and/or the oppositely directed bearing force $F_L$, the neck bushing deforms inwardly in the original hollow space 12 and flattens. The flattening takes place maximum so far until the neck bushing 20 applies pressure to the roll neck 10 and is supported thereby. The neck bushing conforms locally and elastically to the profile 40 of the roll neck and deforms again to its initial condition after being unloaded. The flattening increases the pressure-active surface between the neck bushing 20 and the bearing bushing 51. The load-carrying oil film 30 is provided between the neck bushing 20 and the bearing bushing 51. The load-carrying oil film forms a so-called hydrodynamic load-carrying oil film support. The inventive roll arrangement leads, due to the increase of the pressure-active surface, to the increase of the loading capacity of the load-carrying oil film support between the neck bushing and the bearing bushing.

In reality, the rolling force and/or the bearing force do not act punctiformingly or linearly but rather in form of force curve. The force curve has a flat elongation in the circumferential direction and the axial direction. Due to flattening of the neck bushing and, thereby, increase of the pressure-active surface, a noticeable increase of the load-bearing capacity of the roll arrangement for the flatly elongated force curve is achieved.

The inventive roll arrangement has further advantages in comparison with a roll arrangement in which the neck bushing is force-lockingly connected with the roll neck with a pre-stress in the unloaded condition, e.g., as a result of shrinkage. The necessary force that need be applied for the elastic flattening of the neck bushing, is smaller because of the inventive hollow space in comparison with a construction with a pre-stress between the neck bushing and the neck. The pre-stressed construction requires a greater force in order to realize the same deformation of the neck bushing.

Other Aspects:

Because of a small wall thickness of the neck bushing 20, the deformation under load of the inner surface 21 of the neck bushing 20 is reproduced, without change, i.e., in the same direction on the outer surface 22 of the neck bushing 20 and, thereby, results in increase (widening) of the pressure-active surface between the neck bushing 20 and in the bearing bushing 51 which faces the force direction. This further results in uniform distribution of the lubrication film pressure, so that a greater force can be absorbed, without the maximum pressure in the load-carrying oil film 30 exceeding the threshold of the material of the bearing bushing or the anti-friction metal coating. As a result, the inventive arrangement leads to increase of the loading capacity of the hydrodynamic lubricant or load-carrying oil film support between the neck bushing 20 and the bearing bushing 51.

LIST OF REFERENCE NUMERALS

100 Roll arrangement
10 Roll neck
11 Roll barrel
12 Hollow space
13 Outer surface of the roll neck
14 Bearing surface
15 Central axis
16 Axial bearing-inner ring
17 Pressure shoulder ring
18 Nut
19 Counter-nut
20 Neck bushing
21 Inner surface of the neck bushing
22 Outer surface of the neck bushing
23 Carrier Element
25 Stop
26 Hub portion
27 Threaded neck
28 Spacer ring

30 Load-carrying oil film
31 Lubricant film
40 Profile
44 Pressure distribution-state-of-the art
46 Optimal pressure distribution
50 Chock
51 Bearing bushing
R(x) Profile as a mathematical function
$F_W$ Rolling force
$F_L$ Bearing force
t Profile depth
d Wall thickness of the neck bushing

The invention claimed is:

1. A roll arrangement (100) for use in metallurgy, comprising a roll having a roll barrel (11) and two roll necks (10);

at least one neck bushing (20) for receiving at least one roll neck (10) for joint rotation therewith and without a radial clearance, characterized in that in an unloaded condition, a circumferential rotationally symmetrical hollow space (12) is formed between the neck bushing (20) and the roll neck (10) at least in partial region therebetween, and the hollow space (12) is limited, viewed in a longitudinal direction of the roll arrangement (100), by a rotationally symmetrical concave shape of the outer surface (13) of the roll neck (10) and/or of the inner surface (21) of the neck bushing.

2. An arrangement according to claim 1, characterized in that the outer surface (13) of the roll neck (10) or the inner surface (21) of the neck bushing (20) continues, in the region of its concave shape, when viewed in the longitudinal direction of the roll arrangement (100), at least sectionally in form of a straight-line, a sinus curve, a polygonal curve R(x)n-tenth degree, or as combination thereof.

3. An arrangement according to claim 2, characterized in that a profile of the outer surface (13) of the roll neck (10) or the inner surface (21) of the neck bushing (20) in a region of its concave shape, when viewed in the longitudinal direction of the roll arrangement (100), in the transition region between two adjacent sections, is continuously differential.

4. An arrangement according to claim 1, characterized in that a volume of the hollow space (12) is formed so that it conforms to a maximal bearing force in a loaded condition as long as deformation of the neck bushing (20) remains in an elastic region.

5. An arrangement according to claim 1, characterized in that the outer surface (13) of the roll neck (10) and the inner surface (21) of the neck bushing are formed as truncated cone.

6. An arrangement according to claim 1, characterized in that the outer surface (13) of the roll neck (10) and the inner surface (21) of the neck bushing (20) are cylindrical.

7. An arrangement according to claim 1, characterized in that the roll is formed as back-up roll, intermediate roll, or work roll for use in a rolling mill stand.

8. An arrangement according to claim 1, characterized in that the arrangement further comprises:

at least one chock (50) with a bearing bushing (51) in which the neck bushing (20), together with the roll neck (10) and/or with the roll, is received, with a load-carrying oil film (30) being provided between the neck bushing (20) and the bearing bushing (51).

* * * * *